United States Patent [19]

Bell

[11] Patent Number: 5,027,980

[45] Date of Patent: Jul. 2, 1991

[54] DUAL COMPARTMENTED CONTAINER FOR RECONSTITUTING POWDERED MILK AND THE LIKE

[76] Inventor: Michael Bell, 3549 West 4th Ave., Vancouver, British Columbia, Canada, V6R 1N9

[21] Appl. No.: 601,615

[22] Filed: Oct. 12, 1990

Related U.S. Application Data

[63] Continuation of Ser. No. 327,837, Mar. 23, 1989, abandoned.

[51] Int. Cl.[5] ..... B65D 35/22

[52] U.S. Cl. ..... 222/94; 222/145; 206/219; 383/37; 383/39

[56] References Cited

U.S. PATENT DOCUMENTS

| | | | |
|---|---|---|---|
| 3,208,640 | 9/1965 | Paulson | 222/541 X |
| 3,255,872 | 6/1966 | Long et al. | 206/219 |
| 3,559,416 | 2/1971 | Cornwall | 206/219 X |
| 4,009,778 | 3/1977 | Howell | 383/40 X |
| 4,226,330 | 10/1980 | Butler | 206/219 X |
| 4,458,811 | 7/1984 | Wilkinson | 383/38 X |
| 4,557,377 | 12/1985 | Maloney | 383/38 X |

*Primary Examiner*—Michael S. Huppert
*Assistant Examiner*—Gregory L. Huson
*Attorney, Agent, or Firm*—Armstrong, Nikaido, Marmelstein, Kubovcik & Murray

[57] ABSTRACT

A bag for mixing powdered skim milk. The bag comprises an outer, conventional flexible dairy bag for holding milk to be distributed commercially. The bag is formed from sheets of plastic, heat sealed along adjacent peripheral edges. An opening is provided through which to fill the bag, the opening provided with a cap or a flexible spigot through which milk within the bag is to be dispensed. The bag further comprises an inner bag of tubular shape made of a frangible plastic sheet and heat sealed along at least two common adjacent seams with the outer bag so that the non-heat-sealing of one of the common seams, when the inner bag is in position, provides external access for filling the inner bag while the inner bag volume remains separated from the outer bag volume.

6 Claims, 1 Drawing Sheet

DUAL COMPARTMENTED CONTAINER FOR RECONSTITUTING POWDERED MILK AND THE LIKE

This application is a continuation of application Ser. No. 327,837 filed Mar. 23, 1989 and now abandoned.

BACKGROUND OF THE INVENTION

The present invention relates to a novel bag within which to reconstitute powdered milk, and more particularly relates to such a bag and its method of construction for use in dispensing powdered milk commercially, for example in institutions and the like, through conventional commercial milk dispensing cabinets.

In my earlier U.S. Pat. No. 4,651,898, I have described an apparatus for controlling the flow of two streams of whole milk and reconstituted powdered milk simultaneously, from commercial milk dispensing cabinets found in cafeterias, institutions and the like, to provide a palatable milk product. The whole milk and reconstituted powdered milk are held in standard (for example, five gallon) dairy bags having a flexible spigot or snip tube extending from an opening by which the bag had been previously filled. To obtain a five gallon bag of reconstituted powdered milk, conventionally a bag with the appropriate amount of dry powdered milk held within may be provided and about five gallons of tap water added through the opening where the snip tube is attached. The snip tube would then be snapped into a permanent position sealing the water inside the bag.

The problem with such a method is that health regulations may require the water to be pre-chilled for example to 40° F. or below to minimize bacterial growth and the like, before reconstituting the milk. The water being added to the bag of dry powdered milk may well be much warmer than that, creating a potential health hazard until the milk becomes chilled down sufficiently.

A considerable effort has been made in recent years by milk producers, and particularly by those marketing powdered milk, to find technology which will permit powdered milk to be reconstituted commercially under hygienic conditions with water which has been properly pre-chilled.

In order to achieve this end, in accordance with the present invention, a compartmented package, appropriate to mix within skim milk and water, has been developed.

Compartmented packages are, generally speaking, well-known in the prior art. Examples of compartmented packages for various applications have been described and illustrated for example in the following references: U.S. Pat. No. 2,157,169 of Foster issued May 9, 1939; U.S. Pat. No. 3,596,801 of Barnack issued Aug. 3, 1971; U.S. Pat. No. 3,429,429 of Poitras issued Feb. 25, 1969; U.S. Pat. No. 1,332,985 of Jarrett issued Mar. 9, 1920; U.S. Pat. No. 2,727,987 of Kabnick issued Sept. 10, 1929; U.S. Pat. No. 2,647,681 of Paoli issued Aug. 4, 1953; U.S. Pat. No. 2,824,010 of Pedersen issued Feb. 18, 1958; U.S. Pat. No. 2,885,104 of Greenspan issued May 5, 1959; U.S. Pat. No. 3,156,369 of Bowes, et al issued Nov. 10, 1964; U.S. Pat. No. 3,779,372 of Gil de Lloret issued Dec. 18, 1973; U.S. Pat. No. 3,813,54 of Gilliam issued May 28, 1974; U.S. Pat. No. 4,519,499 of Stone et al. issued May 28, 1985 and U.S. Pat. No. 4,548,606 of Larkin issued Oct. 22, 1985.

Of particular interest in these references is U.S. Pat. No. 2,157,169 of Foster which describes and illustrates a flexible bag of canvas or similar material containing one of the constituents for a heat producing chemical reaction, and, within that bag, a second compartment of readily frangible material such as glacine paper for separate storage of the other of the components. The mouth of the inner bag is stitched along one edge of the outer bag. By destroying the partition between the two compartments, the constituents are permitted to be mixed.

One of the difficulties experienced with mixing of instant powdered milk is to ensure that there is a quick release of the powder into the water, with a maximum dispersal of the instant powder. The dual compartment arrangement proposed by Foster would be unsuitable for such application, if powder were held in the inner bag, since powder would not readily come out of that bag without kneading and the like. As well, once that inner bag is opened, much of the integrity of the inner bag remains, so that there would be a tendency for water to seep into the inner bag and only partially dissolve the milk powder, creating a paste.

Barnack U.S. Pat. No. 3,596,801 and Poitras U.S. Pat. No. 3,429,429 describe and illustrate alternative forms of flexible walled containers with separate interior compartments.

None of these prior art references however, provides or suggests a solution to the problem of providing a structure for mixing in large volumes at the appropriate time water and powdered milk for commercial purposes. It is thus an object of the present invention to provide such a structure and method of doing same. It is a further object of the present invention to provide a structure within which powdered milk may be reconstituted which is easy to use by relatively untrained staff, and which consistently will provide a quality product of well-mixed reconstituted milk. It is a further object of the present invention to provide such a structure which is both hygienic to use and will make it possible to readily reconstitute the dry powdered milk and water only after the water has been sufficiently chilled to satisfy health regulations.

SUMMARY OF THE INVENTION

In accordance with the present invention, a bag is provided for mixing powdered skim milk. The bag comprises an outer, conventional flexible dairy bag for holding milk to be distributed commercially. The bag is formed from sheets of plastic, heat sealed along adjacent peripheral edges. An opening is provided through which to fill the bag. The opening has a means to releasably retain in sealable position closing it a cap or a flexible spigot or snip tube through which milk within the bag is to be dispensed. The bag further comprises an inner bag of tubular shape made of a frangible plastic sheet, and heat sealed along at least two common adjacent seams with the outer bag.

In a preferred embodiment the inner bag shares three common adjacent edge seams with the outer bag and the outer bag consists of a standard five gallon dairy bag.

There is also provided a method of producing a bag for holding, in separate compartments, dry powdered milk to be reconstituted with water. The method comprises the steps of forming an exterior bag by heat sealing the edges of plastic sheets along seams to produce a bag of generally rectangular configuration and incorporating an interior bag, at the same time, by heat sealing within the exterior bag a further plastic sheet along at least two common adjacent seam, leaving open one of the seams of the interior bag and a portion of the corresponding seam of the exterior bag to provide access to the interior bag for filling it with powdered milk.

As will be described in more detail hereinafter, the dairy bag made in accordance with the present invention is easy to manufacture and use, and is reliable in ensuring a well-mixed final product which will be acceptable to most commercial institutions wishing such a product.

BRIEF DESCRIPTION OF THE DRAWINGS

These and other objects and advantages of the invention will become apparent upon reading the following detailed description and upon referring to the drawings in which.

Figure 1:
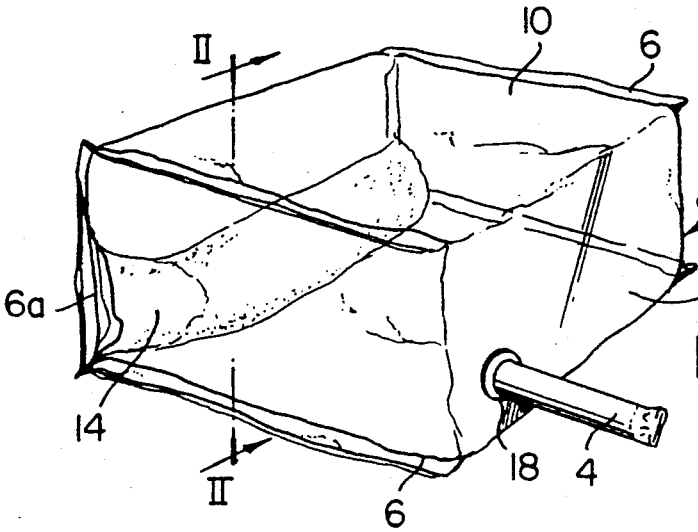
FIG. 1 is a perspective view of a dairy bag in accordance with the present invention.
Figure 3:
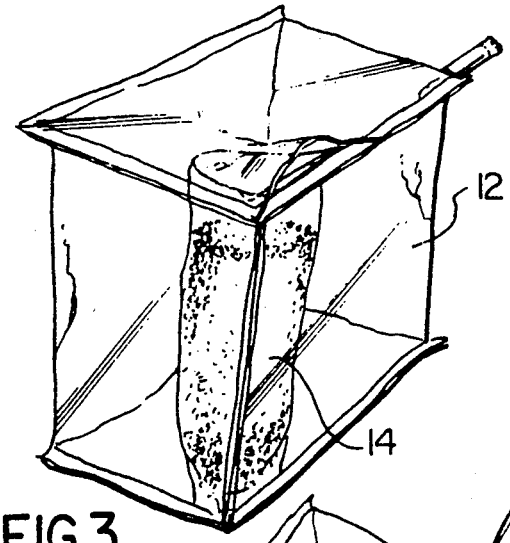
FIGS. 3 and 4 are schematic views illustrating the handling of the structure of FIG. 1, namely the filling of the inner bag with powdered milk (FIG. 3) and the releasing of powdered milk from the inner bag into the water of the outer bag to reconstitute the powdered milk (FIG. 4).
Figure 2:
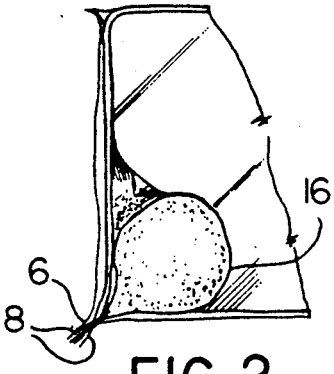
FIG. 2 is a partial section view of the structure of FIG. 1 along II—II.
Figure 4:
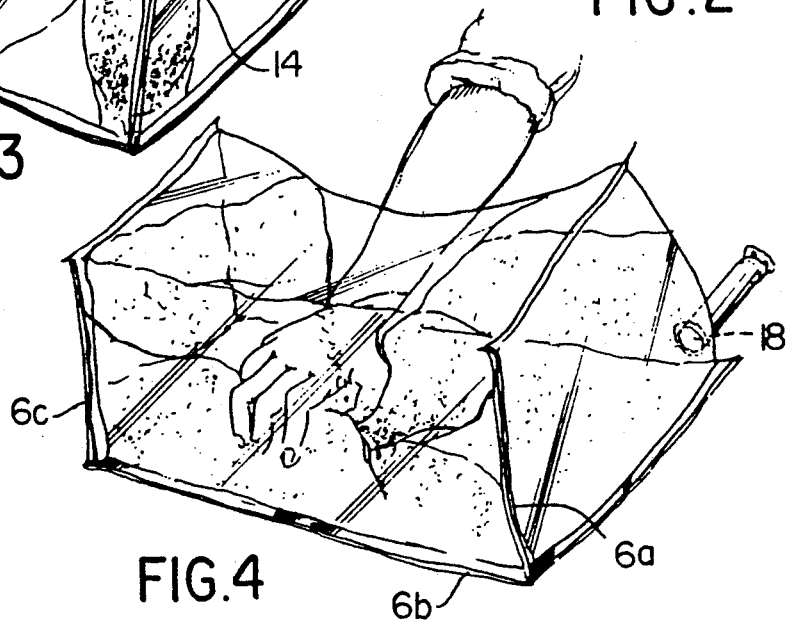

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE DRAWINGS

In the drawings, similar features have been given similar reference numerals.

Turning to FIG. 1, there is illustrated a dairy bag 2 for mixing and dispensing powdered milk in accordance with the present invention. In practice, this dairy bag will be used in commercial milk coolers and dispensers in conjunction with a dairy bag of similar size and containing whole milk, for providing a palatable milk product made up of blended equal portions dispensed simultaneously from each of the two bags.

Dairy bag 2 may be made of a standard five or six gallon or 10 or 20 liter dairy bag with a flexible snip tube 4 through which the contents will ultimately be dispensed. Dairy bag 2 is formed of sturdy polyethylene sheets, preferably doubled, heat sealed on seams 6 along adjacent edges 8 of the sheets 10 to form an outer bag 12 designed to contain water, and, ultimately, reconstituted powdered milk.

Within outer bag 12 and closed by three common seams, 6*a*, 6*b*, and 6*c* of the outer bag 12, is an inner bag 14. In the illustrated embodiment this is made by folding a single sheet of frangible polyethylene 16 over on itself and heating sealing its both sides together along seam 6*b* together with the corresponding edges 8 of sheets 10. So that inner bag 14 may be filled with dry powdered milk and kept separate from the contents, if any, of outer bag 12, one of the seams (e.g. 6*a*) at the end of inner bag 14 is not heat sealed at the same time as seams 6*b* and 6*c* are, thereby providing an opening from the exterior of bag 2 to the interior of inner bag 14. Once an appropriate amount of dry milk powdered has been inserted into inner bag 14, seam 6*a* is then heat sealed, completely enclosing each of inner and outer bags 14 and 12 respectfully. For reasons which will be explained in more detail hereinafter, it is preferred that inner bag 14 be secured along a seam 6 which is opposite from snip tube 14 and at the bottom of dairy bag 2 when in operative position.

Alternatively, an inner bag 14 may be provided having two common seams 6*a* and 6*b*, with outer bag 12, for example by heat sealing a smaller square bag in the corner of outer bag 12 by sharing two common seams 6*a* and 6*b*. This would result in a similar type of dairy bag 2, but would be slightly more expensive to manufacture than the illustrated embodiment where three common seams are shared by inner and outer bags 14 and 12.

In operation, the process that would take place in an institution using dairy bag 2 in accordance with the present invention, which bag would be provided to the institution with inner bag 14 filled with an appropriate amount (e.g. five pounds) of dried milk powder, would be as follows. A kitchen employee would place the five gallon dairy bag 2 containing inner bag 14 filled with powder, in a reusable dairy case (not illustrated). Five gallons of tap water would then be added to the bag through the opening 18 where snip tube is attached. The snip tube would then be snapped into a permanent position sealing the water inside the bag. There would now be a five gallon dairy bag containing five gallons of water and a separate inner bag 14 containing the appropriate amount of dried milk powder. This would be refrigerated for use the following day, when the temperature of the water had been lowered to an appropriate amount (e.g. 40° F.). An employee would then push his or her hand into a corner of the dairy bag 2 opposite from inner bag 14. This would reverse the bag around the employee's hand like a glove due to the water pressure allowing the staff member to physically slash the inner bag 14 by the action of his or her hand through the outer bag 12, allowing the powder and water to be mixed together. Because of the fact that the inner bag 14 is then in a position at the bottom of dairy bag 2, and since a considerable amount of air is entrained with the dried milk powder when inner bag 14 is filled, when the walls of inner bag is slashed, air and dry milk powder rush out of inner bag 14 with considerable force and turbulence, producing an excellent and otherwise-hard-to-achieve mixing of the milk powder with the water.

The lower corners of the bag will become common to both bags once the inner bag is slashed. This allows the person mixing the milk to also enter the bag from the bottom corners (after it is slashed) (reverse glove) to ensure that all powder is released from the lower corner.

The three common seams permit the reversing of the lower corners unlike well-known prior art devices.

The three common seams also hold the inner tube of powder in position so a long slashing motion can ensure that the bag is fully opened, without the inner bag shifting. For example, an inner bag such as that of Foster U.S. Pat. No. 2,157,169 would shift and permit a small tear only.

The dairy bag 2 in accordance with the present invention provides the benefits of enabling a hygienic and simple means to satisfy existing health regulations on reconstituting of milk products. It also provides a structure which can be manufactured by a simple modification of the existing dairy bag (which would normally consist strictly of outer bag 12 with snip tube 4 as a cap in position over opening 18).

Thus it is apparent that there has been provided in accordance with the present invention a dual compartmented container for reconstituting powdered milk and the like that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A bag within which to mix powdered milk with water, the bag comprising:

(a) an outer, conventional flexible dairy bag for holding milk to be distributed commercially, the bag formed from sheets of plastic, heat sealed along adjacent peripheral edges, and having an opening through which to fill the bag, the opening being provided with a flexible spigot retained in sealable position through which milk within the be is to be dispensed, and with a cap for closing the flexible spigot, the outer bag having a base portion and side portions; and (b) an inner bag of tubular shape made of a frangible plastic sheet, sharing and heat sealed along at least two common adjacent seams with the outer bag, the opening being located on a side portion opposite from the side portion of the outer bag where the inner bag is positioned, the inner bag when in use being seated on the base portion of the outer bag so as to permit contents with air stored within the inner bag to rush out therefrom with substantial force and turbulence to thereby produce efficient mixture of the contents from the inner bag and fluid contained within the outer bag.

2. A bag according to claim 1 wherein the outer bag consists of a standard five gallon dairy bag.

3. A bag according to claim 2 wherein the inner bag is made of one millimeter polyethylene and is designed to contain about five pounds of instant skimmed milk powder.

4. A bag according to claim 1 wherein the inner bag shares three common adjacent edge seams with the outer bag.

5. A bag according to claim 4 wherein the inner bag is formed of a sheet of plastic folded over on itself and heat sealed along its overlapping sides with corresponding edges of sides of sheets forming the outer bag, the ends of the sheet forming the inner bag being heat sealed with adjacent side edges of the sheets forming the external bag, one of these ends of the inner bag and corresponding portions of the corresponding sides of the exterior bag to be heat sealed only after the inner bag is filled with powder milk.

6. A bag according to claim 5 wherein the inner bag is filled with powdered milk.

* * * * *